US005865086A

United States Patent [19]

Petichakis P.

[11] Patent Number: 5,865,086

[45] Date of Patent: Feb. 2, 1999

[54] THERMO-HYDRO-DYNAMIC SYSTEM

[76] Inventor: Haris Petichakis P., Barrio Altamira, Calle 115 No. 33B-70, Sector Pomena a 200 mts. del Puente sobre Aotopista No. 1, Maracaibo - Edo. Zulia, Venezuela

[21] Appl. No.: 731,705

[22] Filed: Oct. 17, 1996

[30] Foreign Application Priority Data

Nov. 2, 1995 [VE] Venezuela ..... 001928

[51] Int. Cl.[6] ..... F01K 13/00

[52] U.S. Cl. ..... 91/4 R; 60/516; 60/325; 60/327; 60/328; 60/429; 60/430

[58] Field of Search ..... 60/327, 328, 429, 60/430, 516, 325; 91/4 R; 417/131

[56] References Cited

U.S. PATENT DOCUMENTS

| | | | |
|---|---|---|---|
| 3,100,965 | 8/1963 | Blackburn | 91/4 R |
| 3,901,033 | 8/1975 | McAlister | 91/4 R |
| 4,148,195 | 4/1979 | Gerstmann et al. | 60/516 |
| 5,461,858 | 10/1995 | Johnson | 60/325 |
| 5,507,144 | 4/1996 | Gray, Jr. et al. | 60/327 |

*Primary Examiner*—Sheldon Richter

*Attorney, Agent, or Firm*—Jay R. Yablon

[57] ABSTRACT

Description of a system of a thermodynamic steam pump for water propulsion, its heating, disinfection and sterilization, or propulsion of other liquids, characterized by use of water steam pressure as the propelling media of a liquid mass directly, without intermediate equipment to convert the energy, which is composed of a pressure tank, an electric input valve, steam under pressure provided by an external source and means for introduction by gravity of the liquid mass to be impulsed, with electromechanical elements to control level and flow, including a heat exchanger where recycled steam is forced through a tube panel which over heats the liquid thus eliminating the existing microbes and bacteria or just taking advantage of said heat exchanger to pre-heat and fluidify heavy crude oils or other viscous liquids with no expense of additional energy. This same thermo-hydro-dynamic system installed in a surface vessel (ship) can act as propulsor of the same by the action and reaction principle. (Jet propulsion.) Also, said system in another version can compress gases in an ample range of pressures. Said system or machine or motor converts the thermal energy directly to mechanical (kinetic) energy without any intermediate intervention or cooperation or existence of metal-mechanical parts or pieces in movement, or consumption of electric power in said energy conversions.

34 Claims, 12 Drawing Sheets

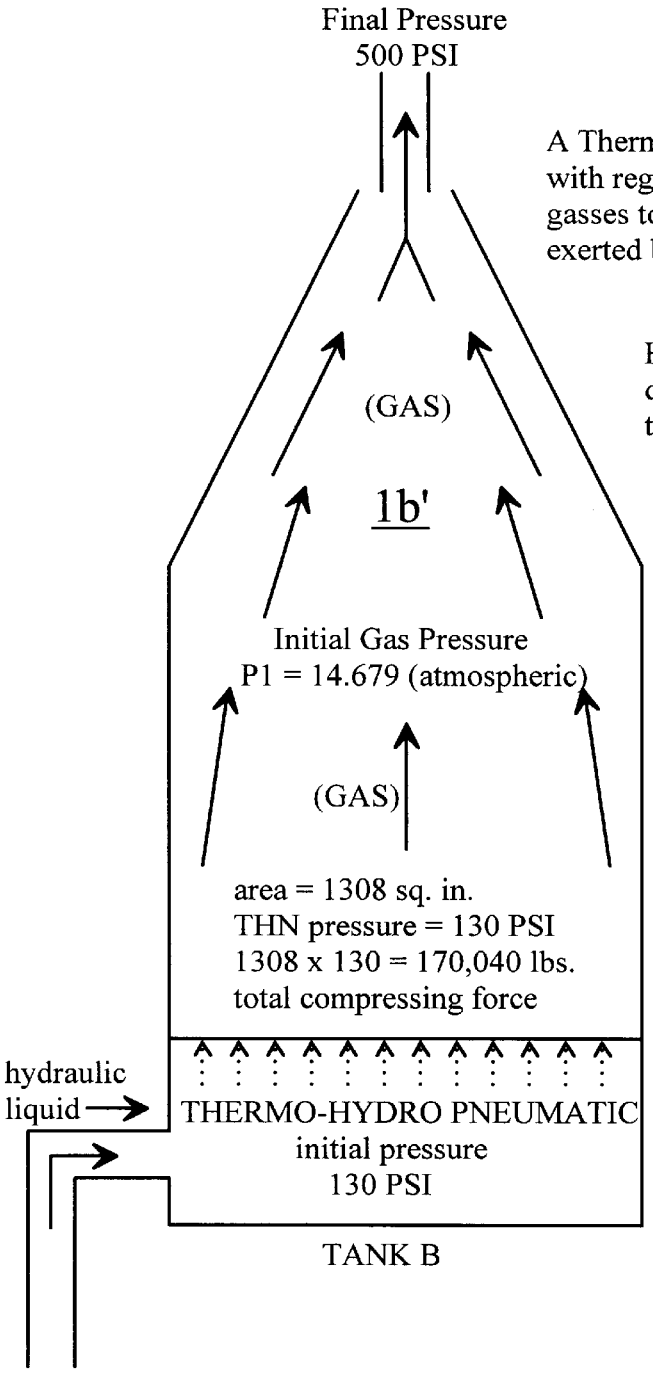

A Thermo Hydro Pneumatic compressor with regular cyclinder tanks can compress gasses to the same pressure as is exerted by the liquid "psitons."

However, if Tank B is of a conical design gasses can be compressed to a multiple of the initial pressure.

Because P1 x V1 = P2 x V2

Final Pressure is $P2 = \frac{P1 \times V1}{V2}$

P1 = Initial pressure
P2 = Final pressure
V1 = Liquid volume transferred from Tank 1a to Tank 1b
V2 = Final compressed gas volume in Tank 1b

FIG. 11

THERMO-HYDRO-DYNAMIC SYSTEM

BACKGROUND OF THE INVENTION

Energy Conversion from one form to another causes an inherent loss, particularly due to the media within which conversion is effectuated. So for example the usable mechanical energy provided by a diesel engine (internal combustion motor) is approximately 34% efficient, electric motors are about 80% efficient, steam turbines are about 70% efficient, and gas turbines have only about a 27% efficiency.

The problem is even greater when several consecutive conversions are required, as for example, in actual pumping systems in which electrical energy is converted by an electric motor to mechanical energy which is in turn converted to kinetic energy by a rotative pump to move a liquid, with the corresponding losses in each step. And this does not even include the series of energy conversions and their losses required to produce electric energy by converting fossil energy to heat, heat to steam (enthalpy), steam to rotational mechanical energy (by a steam turbine), and mechanical energy to electric power (by a generator) which in turn is "transformed" and "transmitted" by "transformers". In all, nine energy conversions occur with expensive equipment, and there is a loss of some 70% of the initial fossil energy consumed in thermo electric power stations until the desired liquid pumping is realized, achieving only a poor 30% efficiency of said traditional systems.

OBJECTS OF THE INVENTION

Considering the above, it was theorized and found viable to reduce to practice a system that could convert directly, thermal energy to mechanical/kinetic (hydrodynamic) energy with no electric or metal/mechanical intermediate equipment.

Said system, established in the present invention offers many important advantages as follows:

It is one object/advantage of the present invention that energy cost is substantially decreased by decreasing the energy losses in the energy conversions of the system.

It is a further object/advantage of the present invention to reduce drastically, the financial investment cost in equipment, as it eliminates the structure of generation, transmission and use of electric power required nowadays, particularly when costly electric power is converted and used for simple mechanical power.

Because injected steam pressure is the pumping medium, and the fluid to be pumped is itself the moving part, it is a further object/advantage of the present invention to virtually eliminate maintenance costs by utilizing the direct energy conversion, as no metal/mechanical moving parts exist in the system.

It is a further object/advantage of the present invention to enable liquid impulsed by pressure through the output pipe to be utilized as a primary media to generate mechanical and/or electrical energy if adequate conventional equipment is incorporated, such as turbo-generators or similar equipment. Similarly, this liquid can simply act in direct form as a surface vessel (ships) propulsor based on "action and reaction" principle (retro-propulsion).

It is a further object/advantage of the present invention to enable pumping of any liquid of any viscosity, and of any density. This includes potable water, as well as liquids with solids in suspension (e.g., dirt, sand, sludge, waste water, petroleum, heavy crude oils, mud) that would obstruct or at least damage or wear a traditional pump that uses a solid, mechanical part to pump the liquid.

Consequently, a dirty liquid can be passed through appropriate filters, removing all solids, and leaving it crystal clear. Thereafter, the liquid can be sterilized by passing it through the heat exchanger which is also part of this system.

Similarly, a viscous liquid such as heavy petroleum can be passed through the heat exchanger, and this exchange of heat will fluidify (thin) this liquid for more effective pumping action.

Thus, the pumped water are freed of microbes and viruses, and heavy crude oil or muds are fluidified, taking advantage of the recycled steam's heat, at no extra cost of energy.

Further, since this machine has no mechanical moving parts (i.e., no pistons, etc.) there is no limit to the size of the tanks that may employed in this system. And, since the cost of a tank is much less than that of an equivalent piston, one can use a large number of tanks at comparatively low cost. Thus, this system can be built and operated on any desired scale.

Thus, it is a further object of this invention to enable the cleaning of polluted water back to fresh, sterilized water, helping to reverse the pollution of our lakes, rivers and seas.

It is a further object/advantage of the present invention to enable the compression of gasses (air or other) at the desired pressure taking advantage of the pressure imposed to a liquid column and transferring said pressure to a gas column in a closed cylinder for its compression without intervention of mechanical parts (such as pistons, screws etc), because the liquid acts as the reciprocal piston.

In particular, this machine will compress any gas, including air, and any gas with solids in suspension (e.g., dust, smoke, corrosive gasses), without endangering the compressor, again, since the compressor has no mechanical moving parts, and it is the pumped fluid which is serves as the moving part. In its compressed form, this gas (e.g. air) can then be filtered to remove any offensive particles, and cleanly returned to the atmosphere. (Indeed, the waste emission of the fossil fuel heating the steam can be filtered in this manner.) Any chemical pollutants remaining after physical filtration can similarly be removed through appropriate chemical processes. And, of course, bacteriological pollutants can be removed using the system's heat exchanger.

Thus, given the unlimited scalability of this invention, it is a further object of this invention to provide a method for cleaning a polluted atmosphere on the scale of an entire city, wherein the compressor essentially acts as the lungs of the city, and helps to reverse atmospheric pollution.

SUMMARY OF THE INVENTION

The thermo-hydro-dynamic system disclosed herein can be used to pump or push liquids. It can also be used to compress or pump gases. What makes this unique, and is the fundamental principal of this invention, is that the work is accomplished without the use of or need for any metal or other mechanical moving parts. Specifically, there are no pump impellers or peltons and there are no pistons or membranes. In short, the system disclosed herein is a machine without any mechanical, moving parts. The moving part is the fluid also being pumped, the energy source is a gas (steam) heated by fossil fuel or other heating means, and the solid part is a tank or series of tanks.

This system does not require direct electrical power or any portable (e.g., diesel) power. The energy source is a steam boiler which produces steam at a predetermined pressure and volume needed to accomplish a particular work task. The work (pumping action) takes place in two or more closed cylinders. Either by gravity or by pressure differential the liquid to be pumped fills the cylinders, and pressurized steam is introduced into the first cylinder, pumping/pushing the contents out at a specifically designed flow rate into a pipe or receiver. When the contents of the cylinder have been pumped out, the steam flow stops entering the first cylinder and is directed to the second cylinder where the same process takes place pumping into the same pipe or receiver. This alternating or reciprocating pumping action continues until the work is completed.

Each cylinder is operated in a vertical position and has a steam in and steam out connection at the top of the cylinder. At the bottom of each cylinder is a liquid in and a liquid out connection. Each of the four connections on each of the cylinders has a control valve which can be actuated mechanically or electronically to open and close to obtain optimum operating efficiency.

Pascal's principal of equal pressure is the key to the efficiency as well as the uniqueness of this system. Because liquids do not compress, the application of steam (gas) pressure greater than the pressure (resistance) of the liquid creates a uniform surface contact between the steam and the liquid. It is as if there were a membrane or a metal piston between the two components. In fact, there is nothing between the two components. This piston-like action is accomplished with out any metal, mechanical moving parts.

In particular, this system applies and takes advantage of a number of physical laws and parameters, as follows:

First, the specific gravity of all liquids (e.g., water, petroleum, oil, etc.) is much higher than that of any gas. So the liquid will always occupy the lower portion and the steam the upper portion of a vertical cylinder tank, and remain fully separated during pumping.

Second, according to Pascal's law, steam will press downward onto the liquid's surface in a totally homogeneous form, producing the discharge of the liquid through a discharge pipe with the same static and dynamic pressure imparted by the steam. Contrary to popular misconception, the gas (steam) does not mix with the liquid at all.

Third, contrary to what might be supposed, the steam transfers only a minimum (negligible) quantity of heat (calories) to the liquid, since the liquid's surface is flat (as a crystal) and very few steammolecules directly contact this surface during a period of a few seconds. In actual operation of this machine, it is observed that the discharged liquid undergoes virtually no change in temperature during the pumping process. Further, in each entry/discharge phase, new quantities of the liquid (moving part) are entering this reciprocating machine. This is unlike traditional machines, where a fixed, mechanical moving part is constantly receiving heat energy and must therefore be cooled in some manner to avert damage.

Finally, in each filling cycle, the cylinder takes advantage of gravitational force acting on the liquid (principle of commutating recipients) being introduced into the cylinder.

The compression of gas can be accomplished in a thermo-hydro-dynamic system compressor in a manner similar to the basic two cylinder design concept used in many mechanical systems. A liquid such as hydraulic oil is pumped out of the cylinder, hydrodynamically, into the compressor, which is also a cylinder mounted in a position above the cylinder containing the hydraulic oil. This ensures that the compressing liquid (hydraulic oil etc.) is always below the gas that is being compressed, by virtue of gravitation. Thus, gas can be compressed to a predetermined pressure and then sent either to storage or to its final intended purpose.

Another application of this system is for the propulsion of large ships. Sea water flowing into the cylinders and the discharge from the cylinders are used to propel the ship. No shaft or propeller is needed. This is the principal of action-reaction (retropropulsion) as in the popular Jet Ski. Intrinsic in the system is the need to return the steam as condensate back to the boiler. Before it returns to the boiler there is potentially more work that the steam could do. Through the use of heat exchangers many tasks related or unrelated to the primary use of the system can be handled.

These include, but are not limited to, heating (and thereby, thinning) of heavy petroleum products to be pumped, sterilization of water/waste water being pumped, operation of the boiler condensate and feedwater pump, low pressure electric steam or hydro turbine operation, etc.

In this system, the steam is recycled and reinjected to the boilers as water (condensate or other), substituting for conventional electromechanical pumps, taking advantage of the boiler's own steam pressure which pressure is increased by a feedwater pipe with a conical head design, so to overcome the boiler's steam counter-pressure and thus refill it with water.

The efficiencies and cost savings are as follows: were one to use this system either primarily in the pumping of a liquid through a hydro turbine to generate electricity or secondarily by using the return steam in a steam turbine to generate electricity, one would have the maximum efficiency associated with cogeneration. This is coupled with the fact the driving force, steam power, is being utilized in a system that has no metal moving parts converting this energy into work. This results in less friction, less wear, longer life, less maintenance, etc. A conventional steam boiler operates at approximately 82% efficiency. The system disclosed herein operates at approximately 95% efficiency because it essentially has no moving parts and it is performing multiple tasks. These two basic uses have a combined efficiency of approximately 78%. If one combines the basic two units with other units it will compare favorably to what is standard today. For example, an electric pump, inclusive of all losses from power plant equipment and transmission equipment, has a 27–30% efficiency versus 78% for the disclosed system. Electric power steam turbines have an approximate 52% efficiency versus 63% for this system. Electric power gas turbine generation has a 21–23% efficiency versus a 63% efficiency of this system. Steam-driven marine engines have an approximate efficiency of 50%, diesel-driven of approximately 29%, compared with 74% for this system.

It is to be emphasized that this system is believed to be a novel steam machine, not known in the prior art. It differs from the known piston steam machines constructed about 200 years ago (Watt, Stephenson, Fulton) and since used in locomotives and steam-powered ships, which themselves utilize and move a piston, rod, shaft and wheel to convert the steam energy (enthalpy) to mechanical energy. Similarly, the system disclosed herein differs from a steam turbine, wherein the steam rotates a metal, mechanical turbine piece to generate rotational mechanical energy. And again, it differs from these insofar as it contains no mechanical moving parts.

In this system, the moving part is the liquid being pumped, the energy moving the liquid moving part is steam, and the static, solid part is the tank or tanks containing the liquid and steam. In all other known machines, the static and moving parts are all solid, and the energy supplied (e.g., steam, combustion, explosion, electromagnetic field) to the machine moves a solid part (e.g., piston, turbine or rotor).

Further, in all known machines, a separate mechanical pump, energized by the steam or other energy source, is required to pump a liquid, while in this machine, the steam impulses the liquid directly, achieving an unprecedented shortcut.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

FIG. 11 depicts a conical tank where a gas compressed by the system will increase in pressure inversely proportional to the decrease of its initial volume.

DETAILED DESCRIPTION OF THE PREFERRED EMBODIMENT OF THE INVENTION

Figure 1:
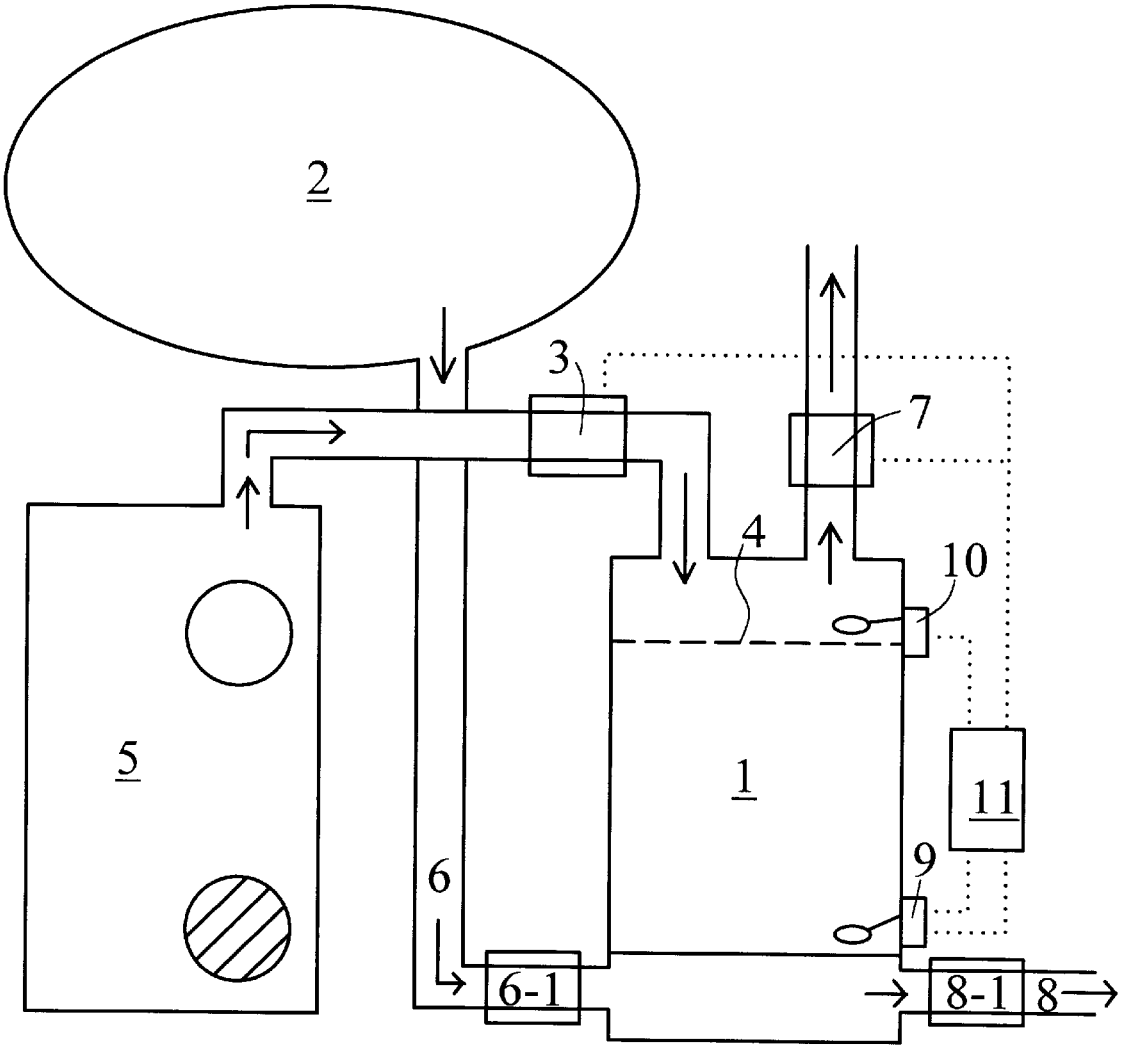
FIG. 1 depicts the basic invention pumping a liquid.

As depicted by FIG. 1, this system operates in a two phase cycle. In the first phase, a vertical cylinder tank 1 is filled with a liquid by gravity (principal of communicating recipients) from a liquid reservoir 2 via a liquid inlet 6. The flow of the liquid opens a check valve 6-1 near the bottom of the cylinder tank 1. As the liquid enters, a lower float control 9 causes the opening of a steam and air escape valve 7 which allows the steam and air to escape while the liquid fills the cylinder tank 1, all controlled by a control module 11.

When the liquid fills the cylinder, an upper float control 10, with a limit switch, sends a signal to the control module 11, electrically closing the steam and air escape valve 7 and opening a steam injection valve 3. This starts the second phase.

In the second phase, injected steam from a boiler 5 presses downward on the surface 4 of the liquid that has filled the cylinder 1. The liquid is thus pushed downward and out through an orifice of outlet piping 8 and a check valve 8-1. At the same time the downward pressure of the liquid closes the check valve 6-1 preventing additional liquid from entering.

When a predetermined amount of liquid has been pumped (pressed) out of the cylinder 1, the lower float control 9 is activated, starting the cylinder liquid filling process again.

In order to maintain a constant pressure and flow it is necessary to use two vertical cylinders, operating in a reciprocating or alternating mode. Thus, control module 11 will send a close signal to the steam and air escape valve 7 and an open signal to the steam injection valve 3 on the first cylinder, while at the same time sending an open signal to steam and air escape valve 7 and a close signal to steam injection valve 3 on the second cylinder. The liquid from both cylinders is pumped (pressed) alternatingly into a common outlet pipe. This enables the machine to maintain the constant pressure and flow it was designed for.

Figure 2:
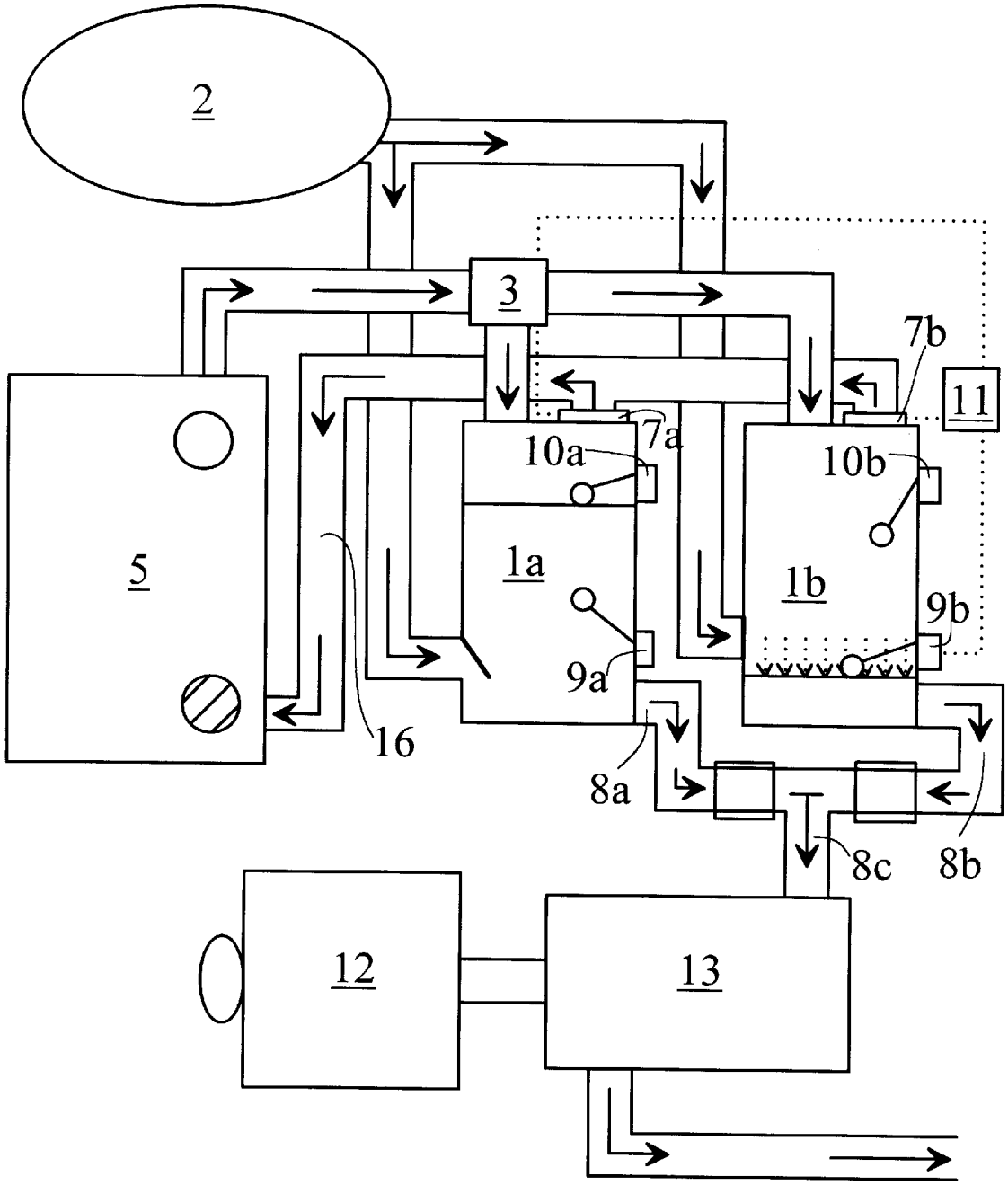
FIG. 2 depicts the basic two-cylinder design of this invention, with a rotary or turbine application.

FIG. 2 depicts the above-described basic two cylinder machine where the liquid, water in this example, is being used to turn a hydraulic turbine 12 and an electric generator 13. Depicted therein are two cylinders 1*a* and 1*b*, with respective float controls 9*a*, 9*b* and 10*a*, 10*b*, respective steam and air escape valves 7*a*, 7*b*, a common control module 11, a common steam injection valve 3, and a common steam and air return line 16 returning steam and air from the cylinders 1*a*, 1*b* to the boiler 5 upon the opening of the escape valves 7*a*, 7*b*. Also depicted are outlet pipes 8*a* and 8*b*, leading to the common outlet pipe 8*c*.

Figure 3:
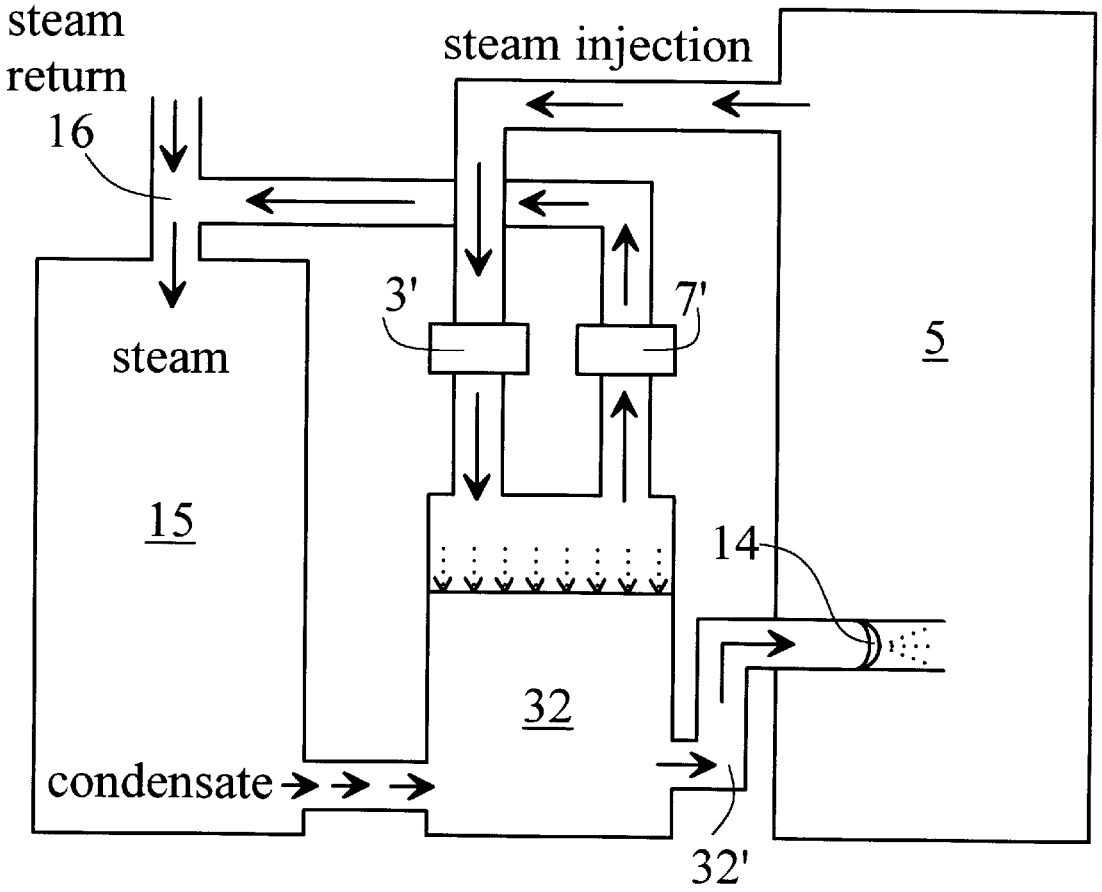
FIG. 3 depicts a boiler feed water pump to reinject water (condensed steam) back into the boiler.

The design of the machine allows for the pumping of the condensate and feedwater back into the water drum or boiler 5 using a feedwater pump 32 as shown in FIG. 3, by the same principles used by this system for all other pumping applications as previously discussed. To overcome the higher pressure in the water drum or boiler, the pressure is increased at the point of injection by means of "strangulating" the water flow using a cone head shaped injector 14, to be further discussed in connection with FIG. 4. This eliminates the need for the traditional electric (mechanical) pump.

The system of FIG. 3 for recycling steam water back into the boiler, makes use of the principles of this invention to do so, again, without the need for any mechanical pump of any type. Steam in the steam and air return line 16 enters into a heat exchanger 15. The uses of this heat exchanger will be discussed further in connection with FIGS. 5 and 6. But for now, it is important to observe that as the steam passes through the heat exchanger, it will lose heat in the exchange, and will condense back into water. This steam recondensed to water (condensate) then continues back into the feedwater pump 32 as shown, so that it may be reinjected and recycled back into the boiler as water (with perhaps additional fresh water) to again be heated by the fossil fuel heating the boiler, converted back into high pressure steam, and again reused to apply pressure to the main cylinders 1*a* and 1*b* discussed earlier in connection with FIGS. 1 and 2.

To press this condensate back into the boiler, once a steam injection control valve 3' is opened and a steam escape control valve 7' is closed, steam from the boiler 5 is injected from the boiler to the top section of the feedwater pump as shown, past control valve 3', applying downward pressure to the condensate (water) as shown by the parallel downward arrows inside the pump 32. This pressure presses this water in the pump 32 through a return line 32', and through the cone head shaped injector 14, which further increases the force to press the water back into the boiler 5 as shown, and which, again, will be further discussed in connection with FIG. 4.

Finally, an additional line running from the top of the feed water pump 32, and past the control valve 7' to the steam return line 16 and the heat exchanger 15 as shown, runs the steam operating the feed water pump 32 through the heat exchanger so that its heat energy can be similarly extracted. In the process of this heat loss, this steam also recondenses to water, and is then fed as condensate back into the feedwater pump 32 to also be recycled as water, back into the boiler.

Figure 4:
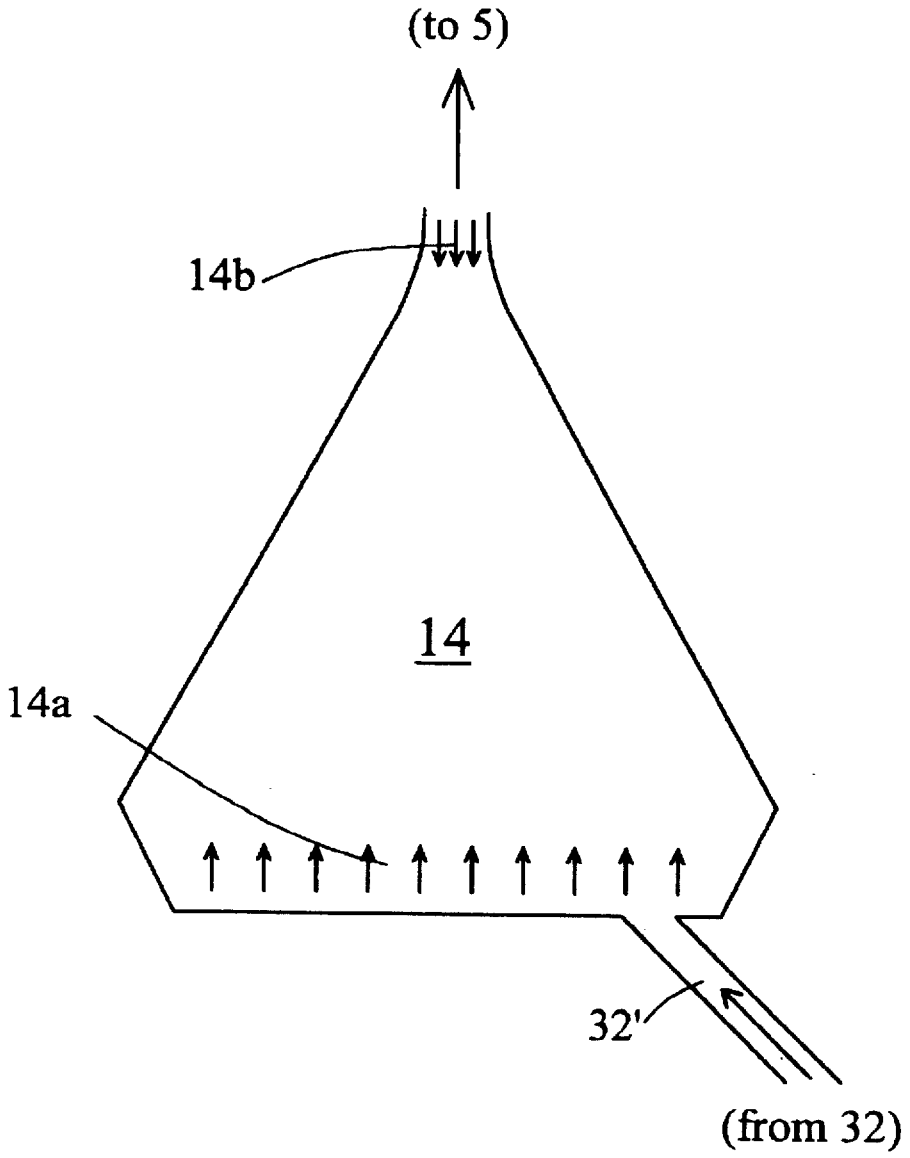
FIG. 4 is a amplification of the cone shaped injector introduced in FIG. 3

FIG. 4 shows the cone head shaped injector 14 in more detail. In order to press the water from the feed water pump 32 back into the boiler 5, it is necessary to ensure that the forward force of the water to be returned to the boiler in region 14*a* of FIG. 4 exceeds the backward force (resistance) emanating from the boiler itself in region 14*b*. A typical backward pressure from the boiler in the upper region 14*b* may be in the range of 1500 pounds per square inch (p.s.i.), while the forward pressure in the lower region 14*a* may be only of the range of perhaps 130 p.s.i. However, if the bottom area in region 14*a* is designed to be, say, 1200 square inches, and the top area is designed to be, say, 60 square inches, then the total forward force in region 14*a* will be 130 p.s.i.×1200 square inches=156,000 pounds, while the total backward force in region 14*b* will be 1500 p.s.i.×60 square inches=90,000 pounds. Thus, the net forward force of approximately 66,000=156,000−90,000 pounds will indeed move the water back into the boiler 5 for further heating and reuse.

Figure 5:
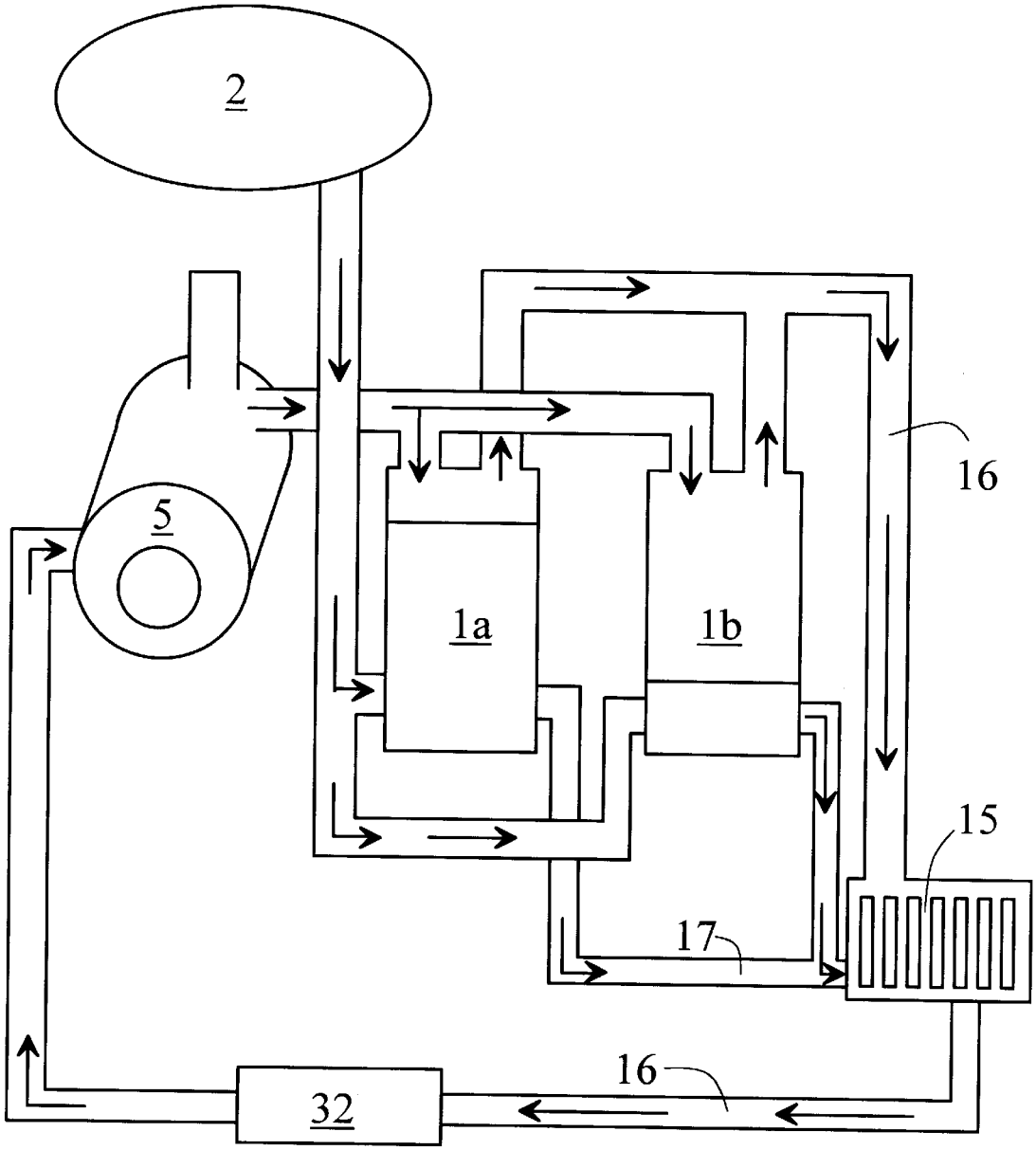
FIG. 5 depicts this system pumping a liquid, wherein the pumped liquid then passes through a heat exchanger for purposes of heating or sterilization.

FIG. 5 shows another design feature of the machine wherein the escaping (return) steam moving through the return line 16 is used to heat or sterilize the liquid 17 being pumped out of the cylinders into the heat exchanger/sterilizer 15 introduced into the return line 16. This allows for the maximum efficient use of the energy that is available in the steam before it condenses and is returned to the boiler 5. Also depicted via the arrow leading out of the exchanger 15, is the sterilized liquid 17 that is being pumped. Note also, the feed water pump 32 to pump water back into the boiler in connection with the conic injector 14 not explicitly shown here, using the system disclosed in FIGS. 3 and 4.

Figure 6A:
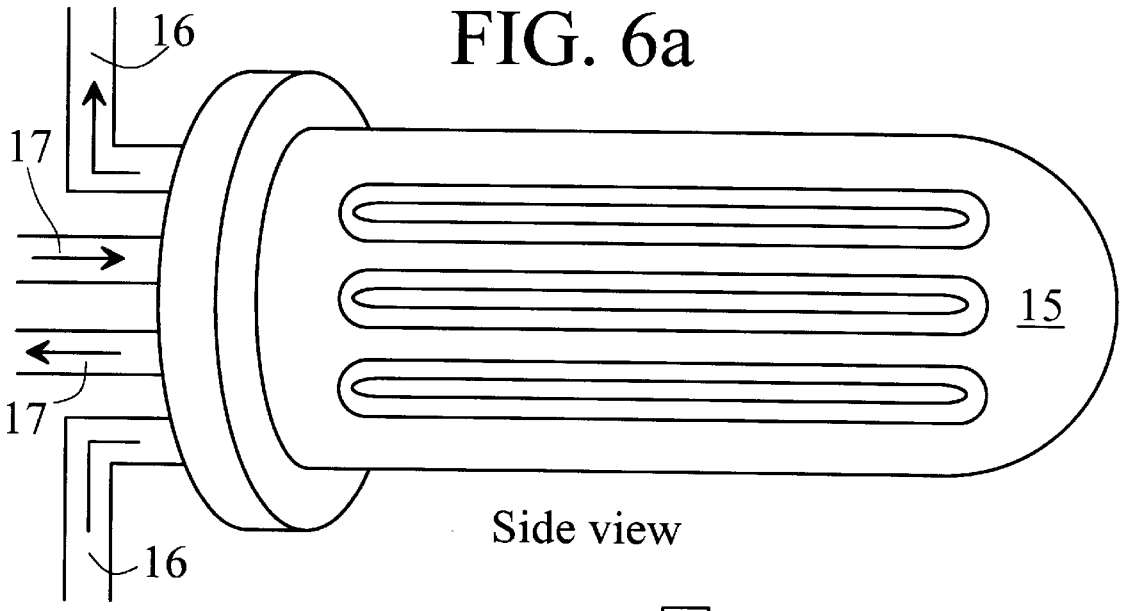
FIG. 6 is an amplification of a typical embodiment of the heat exchanger/sterilizer.
Figure 6B:
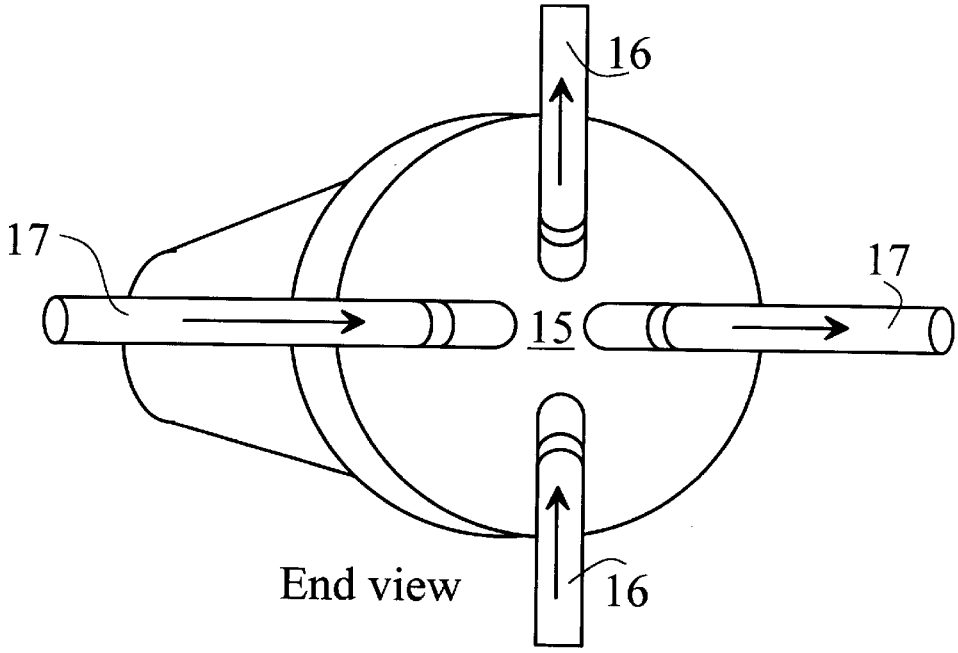

FIGS. 6*a* and 6*b* contain side and front views respectively, amplifying a typical embodiment of the heat exchanger 15, introduced into the return line 16, and showing the intake and outflow of the liquid 17.

Figure 7:
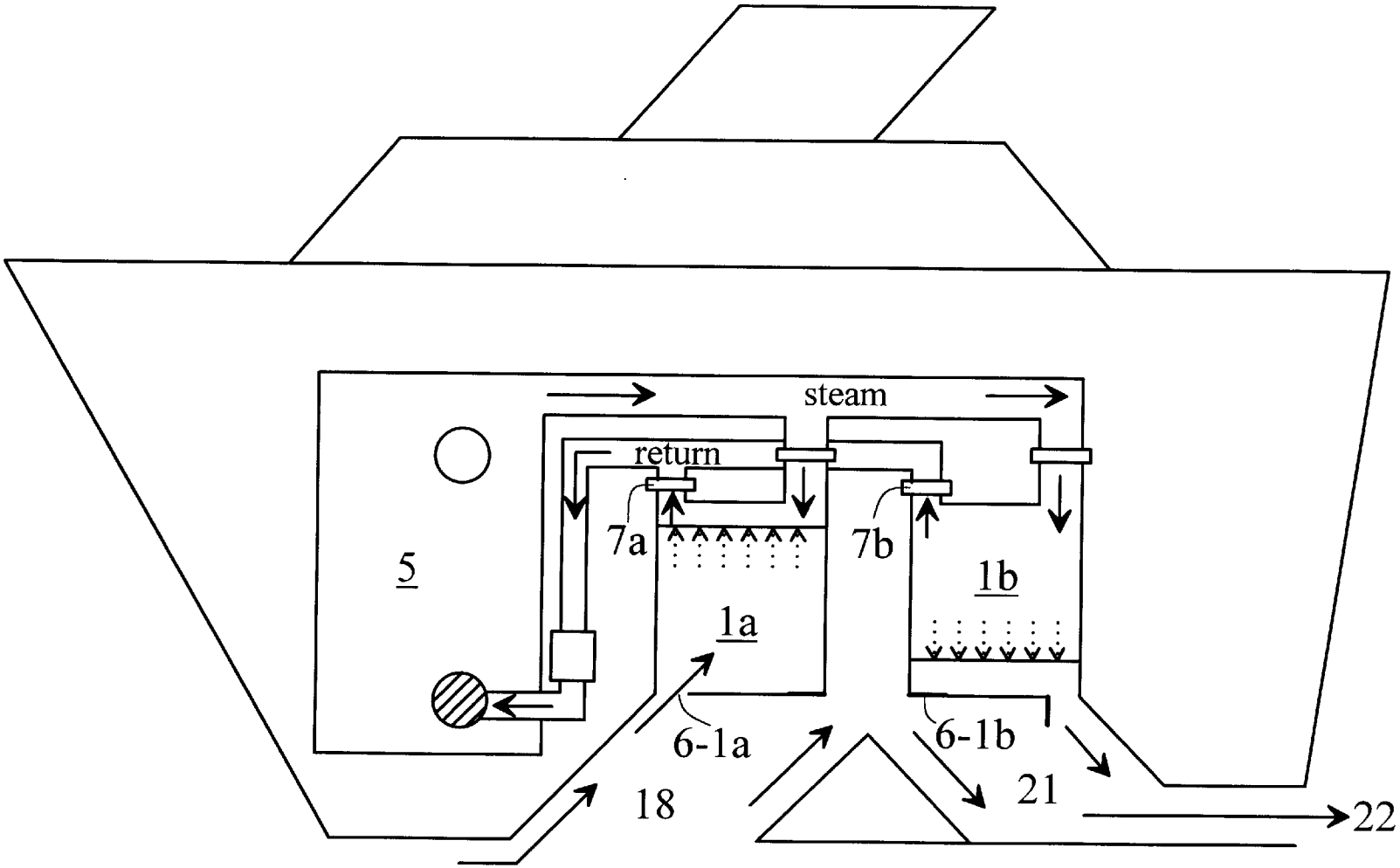
FIG. 7 depicts the system being used as the propulsion system for a ship. (Jet Propulsion).

The machine is also capable of serving as a means of propulsion for water-borne vessels, as shown schematically in FIG. 7. The water upon which the vessel is floating is alternately introduced into the two cylinders 1*a* and 1*b*, using the basic design disclosed in FIG. 2. In phase 1, the water enters into the cylinders through an induction pipe 18 which opens the first cylinder check valve 6-1*a* which sends a signal to open the first cylinder steam and air escape valve 7*a* on the first cylinder 1*a*, while the reverse of this is happening on cylinder the second cylinder 1*b* (i.e., the second cylinder check valve 6-1*b* is closed, and a signal is sent to close the second cylinder steam and air escape valve 7*b*). This allows for a continuous flow rate because of the reciprocating action of the two cylinders, again, using the system described in detail in connection with FIG. 2, above.

In phase 2, the steam pressure created by the boiler 5 enters the first cylinder 1*a*, pushing (pumping) the water through an ejection pipe 21 towards the rear of the vessel, creating a "jet" of water 22 which produces a "reaction force" propelling the vessel forward. As the water is being pumped out of the cylinder the induction check valve 6-1*a* is automatically closed. This, of course, continues through multiple machine cycles, resulting in a continuous propelling flow of water.

As such, this machine, used as a motor, will propel a vessel without the use of steam turbines, internal combustion engines, pistons, bearings, shafts, propellers, transmission axles or any other major traditional metal moving parts. This suggests that there will be a considerable reduction in capital outlay versus the current standard design for vessels. It is logical that with no moving metal parts the maintenance costs will be substantially reduced as well.

An optional variation to the marine motor design would be to incorporate a hydraulic turbine at the tail end of the ejection pipe 21, to increase thrust by rotating a propeller.

Figure 8:
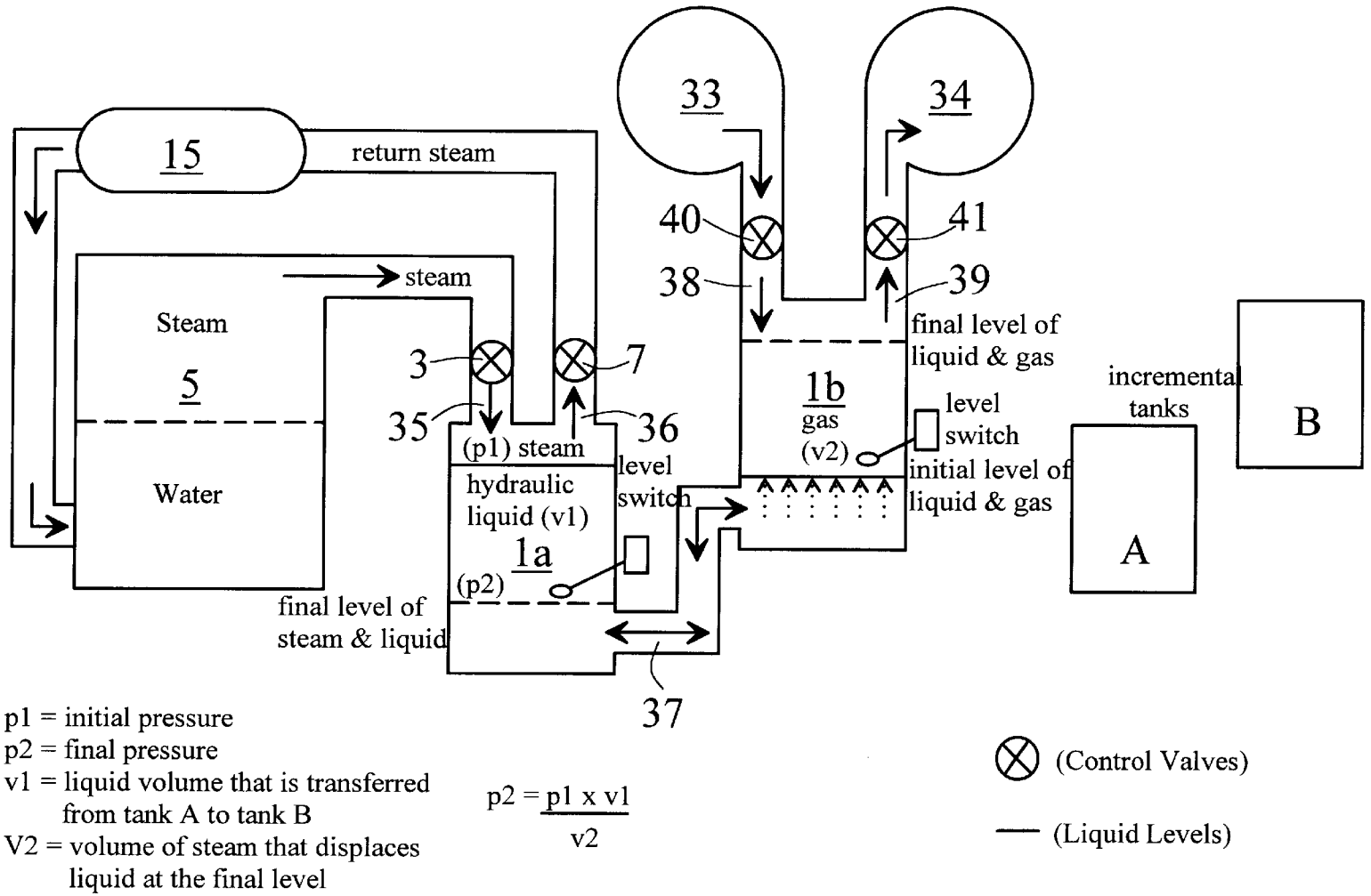
FIG. 8 illustrates the system as used for the compression of a gas.

Another important application for this machine is the compression of gas, depicted by FIG. 8. Traditional gas compressors utilize a metal piston or screw which is normally activated by an electric motor. Compression takes place inside the piston or screw chamber and the compressed gas is released or "pumped" into a storage tank or directly to its final point of use. Compressors in the 2–100 HP size have proven quite versatile. However, larger compressors have a disproportionate capital cost as well as high operating costs when power consumption, efficiency and maintenance are factored in.

The thermo-hydro-dynamic compressor incorporates a conventional steam generator, e.g., boiler 5, two vertical cylinders 1*a* and 1*b*, plus a gas input tank 33 that contains the gas to be compressed and a gas output tank 34 which will receive the compressed gas. Please note that tank 33 may not be necessary if normal atmospheric air is the gas to be compressed.

Cylinder 1*a* receives the desired steam volume and pressure from the boiler 5 through steam input piping 35, and returns the steam through steam output piping 36, as described in detail earlier in connection with FIG. 1. The cylinder 1*a* liquid outlet is piped to the bottom of cylinder 1*b* via connecting piping 37. Cylinder 1*b* is mounted higher and to the side of cylinder 1*a* in such a way that the bottom plate of 1*b* is slightly below the top plate of 1*a*, as depicted. The gas to be compressed enters cylinder 1*b* from input tank 33 through gas input piping 38 and the compressed gas exits cylinder 1*b* through gas output piping 39 into gas output tank 34. As in the basic machine design, the system is controlled by various valves and actuators which are: steam injection 3, steam escape-return 7, low pressure gas entry 40, and a high pressure gas exit 41. Also involved are the floats 9 and 10 and the control module 11 of FIGS. 1 and 2, not explicitly depicted and numbered here.

In Phase 1 of the compression operation, the steam injection valve 3 opens into cylinder 1*a*, while the steam return valve 7 is closed. The steam pushes or pumps the liquid out of 1*a* and into cylinder 1*b* where the incoming liquid, in a piston-like manner, compresses the gas at the top of cylinder 1*b* to the desired pressure and opens high pressure gas exit valve 41 so the gas can enter the gas output tank 34.

In Phase 2 of the compression operation, the steam injection valve 3 closes and the steam return valve 7 opens on cylinder 1*a*. On cylinder 1*b*, gas entry valve 40 opens and high pressure gas exit valve 41 closes, keeping the gas compressed within the output tank 34. The liquid that has been pumped into cylinder 1*b* returns to cylinder 1*a* by the gravitational force. The compressor will keep operating this way until the demand for compressed gas is satisfied.

Figure 9:
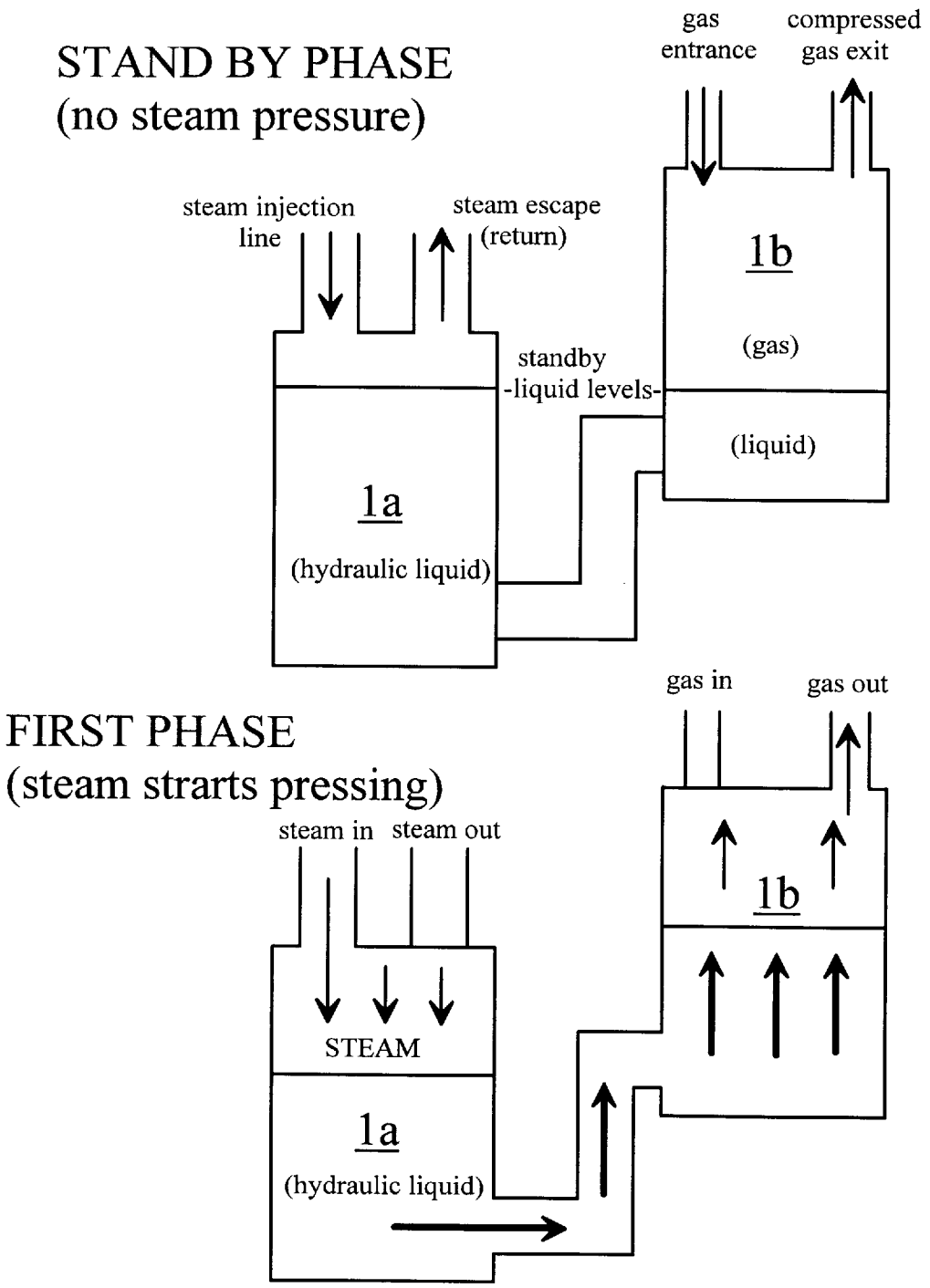
FIG. 9 depicts the two-cylinders in the standby/at rest phase and the startup/operational phase, for gas compression.
Figure 10:
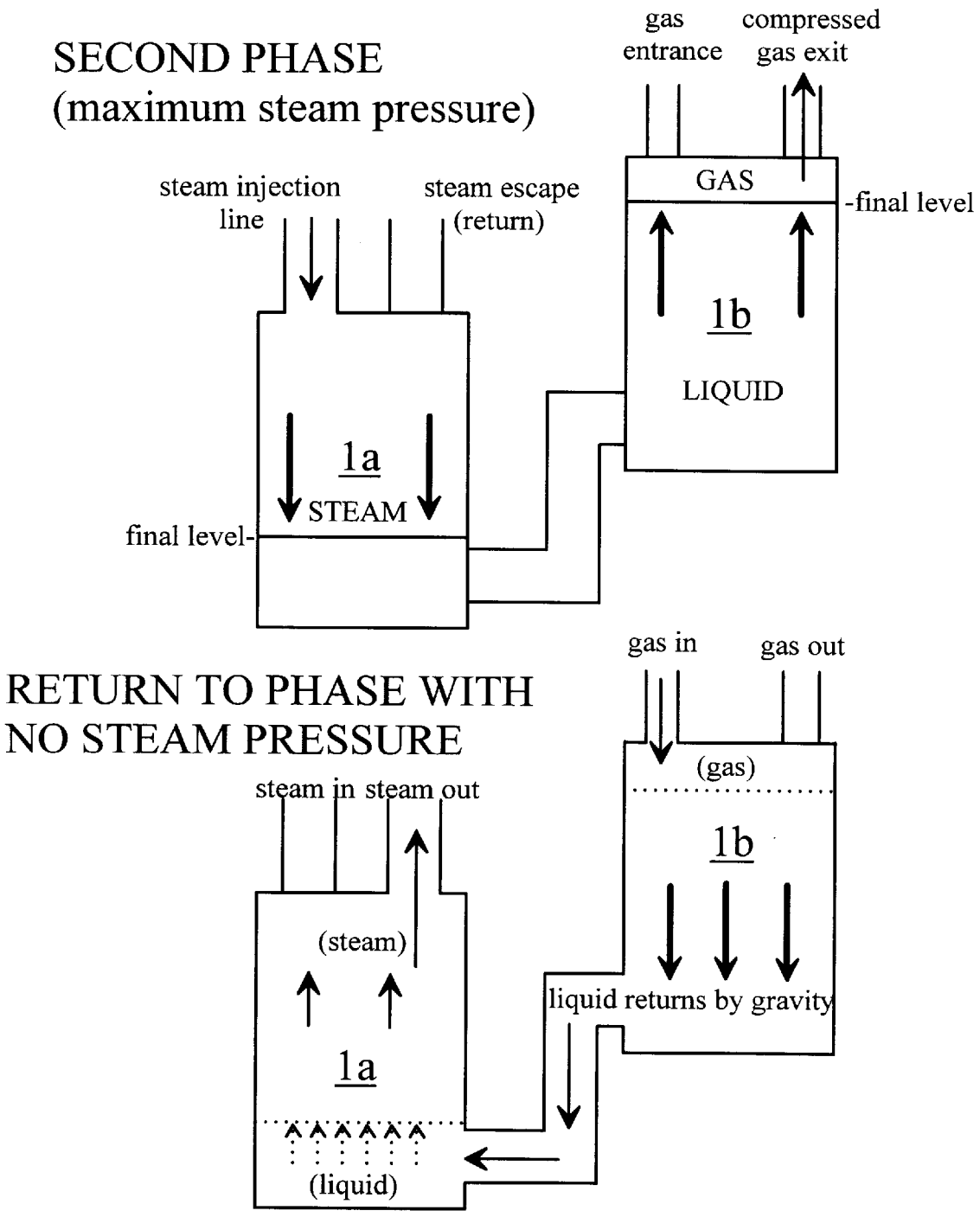
FIG. 10 depicts the two cylinders in the maximum pressure phase and in the return to rest phase for either continued operation (repetition of phases) or shutdown, for gas compression.

The above is further illustrated schematically by FIGS. 9 and 10, which depict the standby phase and first phase (FIG. 9) and the second phase and return to standby phase precedent to the next machine cycle (FIG. 10).

If large volumes of compressed gas are needed, multiple pairs of cylinders can be installed using the same steam source (see the incremental tanks depicted in FIG. 8) and tied in electronically to operate alternatingly or reciprocally with the initial tanks, all supplying compressed gas to the same gas output tank 34, or anywhere else it is needed. There is virtually no limit to the volume or pressure of gas that can be produced by this system since tanks can be as large and as many as needed, whereas pistons and screws of traditional compressors can not.

FIG. 11 outlines how if cylinder 1*b* is conically-designed (1*b*'), the compressed gas produced will have significantly higher pressures. This occurs because the pressure increases inversely proportional to the decrease in the volume of the gas.

In particular, a conically designed gas compressor overcomes high pressure resistance and produce a significantly higher pressure gas flow than the operating pressure of the thermo-hydro-dynamic pump. This occurs because of the differential in surface area between the bottom or base of the cone (larger area, greater total force), where the compressing force starts, and the top of the cone (smaller area, less force or resistance) where the final compression takes place as the liquid piston finishes each stroke.

As an example, suppose the following are the known factors: initial pressure of the gas to be compressed at atmospheric pressure is 14 P.S.I.; volume of the conical compressing chamber is 330 liters; the base of the cone compressing chamber has a diameter of 100 cm.; the top of the cone compressing chamber has a diameter of 5 cm.; and the operating pressure of the pump on the liquid piston is 130 P.S.I. In this situation, the following calculation demonstrates the result:

The surface area of the base of the cone to be compressed is area=radius squared×3.14 (50×50×3.14=7850 centimeters squared) divided by 6 (centimeters per square inch). 1.308 square inches×130 P.S.I. (operating pressure)=170,040 pounds of total force across the base of the cone. The surface area at the top of the cone where compression takes place is area=radius squared×3.14 (2.5×2.5×3.14=19.63 centimeters squared) divided by 6 (centimeters per square inch)=3.27 square inches×130 P.S.I. (operating pressure)=425 pounds of total force or resistance across the top of the cone.

Because the total force on the base of the cone chamber is 170,040 pounds, which is 169,615 pounds greater than the initial force or resistance on the top of the cone chamber (425 pounds), a much higher pressure can be delivered than the 130 P.S.I. operating pressure of the compressor pump. However, the higher the pressure delivered, the less volume of compressed gas will be available per liquid piston stroke, much like any conventional compressor.

The formula used to calculate this, e.g., for 330 liters of gas, is P1 (initial pressure)×V1 (liquid volume used to compress gas)=P2 (final pressure×V2 (final compressed gas volume). Hence, P1 (130 P.S.I.)×V1 (330 liters)=P2 (500 P.S.I.)×V2 (86 liters).

It is only because of the fluidity of the liquid piston design, that it is possible to make a compressor that has this built-in flexibility, and this is achieved without any metal moving parts.

Figure 12:
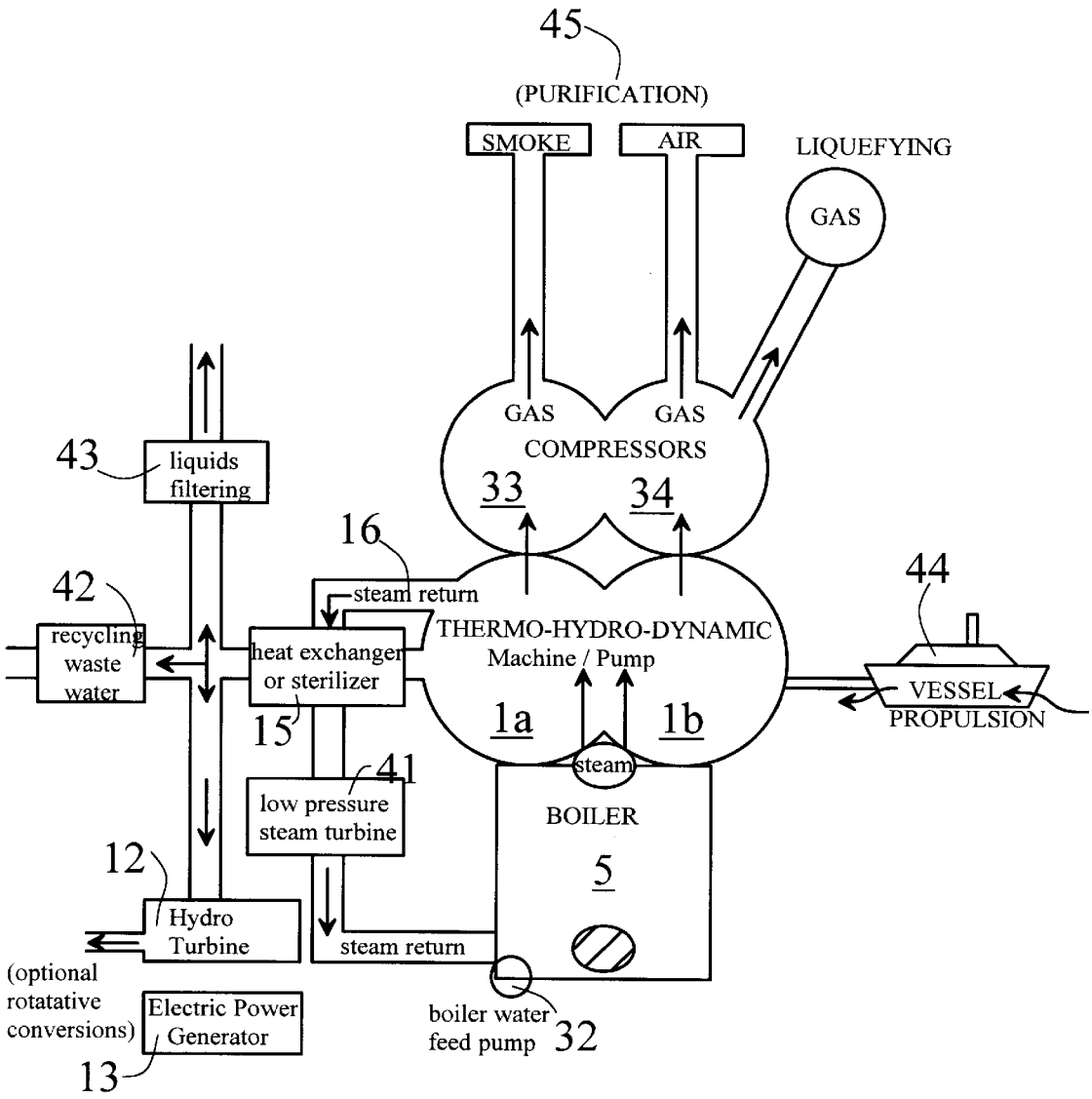
FIG. 12 is a diagram schematically depicting and summarizing many of the currently-envisioned applications for this system.

FIG. 12 summarizes the preferred embodiment of this invention, and the many variations in which it may be configured for a wide range of applications.

The boiler 5 converts the fossil fuel energy to enthalpy (steam pressure), which pumps any fluid (water or other) for many purposes and over the desired distance, by means of the basic thermo-hydro-dynamic system disclosed herein, centered about the cylinders 1*a* and 1*b* as first disclosed in FIGS. 1 and 2. The fluid can be sterilized (water, biological cleaning) or fluidified (petroleum) by the heat exchanger 15, using the thermal energy from the steam in the steam return 16, as discussed in connection with FIGS. 5 and 6. The returning steam may, in another variation, be used to move a low-pressure steam turbine 41 before it is recondensed to water.

Once the steam is recondensed back to water, the condensate is fed back into the boiler (recycled) by means of the feedwater pump 32, using the boiler's own steam pressure, in the manner disclosed in connection with FIGS. 3 and 4.

The pumped water (potable or waste with solids in suspension) can be recycled 42 or filtered by a pressure filter 43 (physical cleaning) without any danger of pump damage, since the pump has no metal moving parts that could be damaged. Chemical conversions (chemical cleaning) may also be applied. The pumped water can further energize a hydroturbine 12 to perform mechanical work, or a power generator 13 for electrical power, as disclosed in connection with FIG. 2. Finally, the same system can propulse a water-borne vessel 44, in the manner disclosed in connection with FIG. 7.

In the gas compression configuration disclosed in connection with FIGS. 8, 9, 10 and 11, using the gas input and output tanks 33 and 34 respectively, this invention can compress any gas including atmospheric air, and any gas with solids in suspension. In addition, the gasses placed under pressure in this configuration can be filtered and sterilized 45 physically, biologically, and chemically, in unlimited volume, in a manner that is impossible for ordinary, moving parts-based compressors. And there is no danger that a mechanical moving part will be damaged by any solids in suspensions, since there are no mechanical moving parts.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A machine wherein the moving part is a non-solid liquid being pumped, the energy moving said non-solid liquid moving part is steam, the static, solid part is a tank system containing said liquid and steam, and said steam is recirculated within said system.

2. The machine of claim 1, wherein said tank system comprises a plurality of tanks.

3. A thermo-hydro-dynamic system for liquid propulsion and compression of gases, comprising:

a liquid mass; steam; at least one closed tank containing said liquid mass and said steam; check valves; a floater level sensor to detect the level of said liquid mass within said tank; and a control module; wherein:

steam pressure generated in a boiler is used as a means to impulse directly, said liquid mass without additional mechanical pieces; wherein the steam pressure is applied into said a closed tank thereby acting as a steam pressure pump against said liquid mass; and wherein steam escaping from said at least one closed tank, and the thermal energy carried by said steam, is recirculated back into said boiler.

4. The system of claim 3, wherein the steam, after it has impulsed said liquid, while it maintains its high escape temperature, is further used to heat the impulsed liquid, by means of a heat-exchanger, up to a sufficient temperature to alternatively eliminate microbes and bacteria, and preheat thereby reducing viscosity and thickness of heavy petroleum products and other viscous liquids.

5. The system of claim 2, further comprising a cone head injector to strangulate the flow of liquid injected into the boiler, thereby increasing the pressure of said liquid.

6. The system of claim 5, wherein the steam, after it has impulsed said liquid, and while it maintains its high escape temperature, is further used to heat the impulsed liquid, by means of a heat-exchanger, up to a sufficient temperature to alternatively eliminate microbes and bacteria, and preheat thereby reducing viscosity and thickness of heavy petroleum products and other viscous liquids.

7. The system of claim 3, wherein said pumped liquid is ejected from an ejection jet at the rear of, and thereby used to propel a water-borne vessel.

8. The system of claim 7, wherein said pumped liquid is used to energize a hydraulic turbine/propeller set, to propel a water-borne vessel.

9. The system of claim 3, wherein the impulsing and pumping of said liquid mass is used to transport said liquid mass from said system, via a fluid pipeline conduit, to a location remote from said system.

10. The system of claim 9, wherein the steam, after it has impulsed said liquid, and while it maintains its high escape temperature, is further used to heat the impulsed liquid mass, by means of a heat-exchanger, thereby reducing viscosity and thickness of said liquid mass, in order to reduce frictional drag of the conduit against said fluid mass during said transport of said fluid mass through said fluid pipeline conduit.

11. The system of claim 3, wherein said liquid mass and said steam are different substances, rather than being identical substances in different, gas and liquid, phases.

12. The system of claim 11, wherein said liquid mass and said steam directly contact one another without any physical separation barrier.

13. The system of claim 2, wherein said control module governs the operations of liquid and steam admission and expulsion into and out from said at least one closed tank so as to open and close the entry and exit of steam and liquid according to the said liquid mass level as detected by said floater level sensor.

14. The system of claim 13, wherein the steam, after it has impulsed said liquid, and while it maintains its high escape temperature, is further used to heat the impulsed liquid, by means of a heat-exchanger, up to a sufficient temperature to alternatively eliminate microbes and bacteria, and preheat thereby reducing viscosity and thickness of heavy petroleum products and other viscous liquids.

15. The system of claim 13, further comprising a cone head injector to strangulate the flow of liquid injected into the boiler, thereby increasing the pressure of said liquid.

16. The system of claim 15, wherein the steam, after it has impulsed said liquid, and while it maintains its high escape temperature, is further used to heat the impulsed liquid, by means of a heat-exchanger, up to a sufficient temperature to alternatively eliminate microbes and bacteria, and preheat thereby reducing viscosity and thickness of heavy petroleum products and other viscous liquids.

17. The system of claim 13, wherein said pumped liquid is ejected from an ejection jet at the rear of, and thereby used to propel a water-borne vessel.

18. The system of claim 17, wherein said pumped liquid is used to energize a hydraulic turbine/propeller set, to propel a water-borne vessel.

19. The system of claim 3, wherein, during the process of filling liquid into the tank, the steam valve and the liquid exit valve are closed until said liquid level reaches said floater, a limit switch of said floater thereafter sending a signal to said control module which opens said steam and liquid exit valves; and wherein, when said liquid level comes down again to a pre-determined level, under the downward pumping effect of the steam pressure, said filling will again occur, with the steam and water exit valves again being closed.

20. The system of claim 19 wherein the mechanical energy from the flow of liquid expelled by the pump is a used as a means to energize and move a hydroturbine, which may in turn move an electric generator, thereby resulting in a hydraulic-turbo-generator.

21. The system of claim 19, wherein said pumped liquid is ejected from an ejection jet at the rear of, and thereby used to propel a water-borne vessel.

22. The system of claim 21, wherein said pumped liquid is used to energize a hydraulic turbine/propeller set, to propel a water-borne vessel.

23. The system of claim 19 wherein said filling and pumping occur alternately in a pair of separate tanks, so to continuously maintain the liquid pressure.

24. The system of claim 23, wherein said pumped liquid is ejected from an ejection jet at the rear of, and thereby used to propel a water-borne vessel.

25. The system of claim 24, wherein said pumped liquid is used to energize a hydraulic turbine/propeller set, to propel a water-borne vessel.

26. A steam-hydro-pneumatic gas compressor by means of which is provided a procedure of gas compression using steam under pressure, which, absent a mechanical piston, acts upon a liquid as a compressing mass, wherein said compressor comprises a gas, whose steam under pressure acts upon a liquid mass contained in a first, vertical cylinder tank, in order to elevate said liquid to another, second tank located in superior level relative to the first tank, said second tank containing the gas to be compressed, wherein said gas, once compressed, is expelled and stored to another storage tank, including in such procedure a first and a second phase, with the possibility of combining said pair of tanks with another similar pair of tanks to act alternatively and so obtain a continuous flow of compression with less fluctuation.

27. The system of claim 26, wherein steam pressure from the boiler acts upon the surface of a liquid contained in the first cylinder tank, expelling said liquid towards the second tank containing atmospheric air or a gas located in a superior level, wherein the bottom of the second tank is located close to the top of the first tank, wherein said gas is expelled from the second tank towards another recipient storage tank for use thereafter.

28. The system of claim 26, in which in a second phase, after the entry of steam into the first tank is closed, the liquid remaining in the upper (second) tank will be returned to the lower (first) tank by the force of gravity, to begin another compression cycle.

29. The system of claim 26, further comprising a series of pairs of tanks, interconnected in alternative cycles, to obtain an approximately continuous flow.

30. A system for gas compression, from a low pressure to high pressure, using the molecule kinetic energy and enthalpy of steam under pressure, said steam pressing a liquid column which liquid column in turn presses a gas column, comprised within in a circuit of resistant metallic receptacles without any direct contact of the steam with the gas to be compressed wherein the gas compression tank is conic and the liquid acts as a piston, so to increase the gas pressure if so is required.

31. A thermo-hydro-dynamic system for liquid propulsion and compression of gases in which steam pressure generated in a boiler is used as a means to impulse directly, a liquid mass without additional mechanical pieces, wherein the steam pressure is applied into a closed tank comprising check valves and a floater level sensor to detect liquid mass level, further comprising a cone head injector to strangulate the flow of liquid to injected into the boiler, thereby increasing the pressure of said liquid.

32. The system of claim 31, further comprising a steam pressure pump, wherein said floater level sensor is in combination with a control module that governs the operations of liquid and steam admission so as to open and close the entry and exit of steam and liquid according to the said liquid mass level.

33. A thermo-hydro-dynamic system for liquid propulsion and compression of gases in which steam pressure generated in a boiler is used as a means to impulse directly, a liquid mass without additional mechanical pieces, wherein:

the steam pressure is applied into a closed tank comprising check valves and a floater level sensor to detect liquid mass level, further comprising a steam pressure pump; wherein said floater level sensor is in combination with a control module that governs the operations of liquid and steam admission so as to open and close the entry and exit of steam and liquid according to the said liquid mass level; wherein the steam, after it has impulsed said liquid, and while it maintains its high escape temperature, is further used to heat the impulsed liquid, by means of a heat-exchanger, up to a sufficient temperature to alternatively eliminate microbes and bacteria, and preheat thereby reducing viscosity and thickness of heavy petroleum products and other viscous liquids.

34. The system of claim 33, further comprising a cone head injector to strangulate the flow of liquid to injected into the boiler, thereby increasing the pressure of said liquid.

* * * * *